US006276888B1

(12) United States Patent
Rubio

(10) Patent No.: US 6,276,888 B1
(45) **Date of Patent: *Aug. 21, 2001**

(54) RECEPTION, CONTAINING AND COMPACTING SYSTEM OF SOLID WASTES

(76) Inventor: Antonio Ramis Rubio, Goleta 51. 07350 Binissalem (Mallorca), Baleares (ES)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/796,456

(22) Filed: Feb. 10, 1997

(30) Foreign Application Priority Data

Feb. 9, 1996 (ES) ..... 9600325

(51) Int. Cl.[7] ..... B66F 3/04
(52) U.S. Cl. ..... 414/406; 414/411; 414/555
(58) Field of Search ..... 414/406, 408, 414/411, 414, 547, 555, 486, 517

(56) References Cited

U.S. PATENT DOCUMENTS 5,049,024 * 9/1991 Chien ..... 414/406 X
5,368,436 * 11/1994 Freiburger ..... 414/406 X
5,458,452 * 10/1995 Pellegrini ..... 414/406

FOREIGN PATENT DOCUMENTS

2539112 * 7/1984 (FR) ..... 414/411
27155 * 3/1977 (JP) ..... 414/547
9827 * 1/1979 (JP) ..... 414/406
1138360 * 2/1985 (SU) ..... 414/408
1373638 * 2/1988 (SU) ..... 414/408

* cited by examiner

*Primary Examiner*—Gregory A. Morse
(74) *Attorney, Agent, or Firm*—John C. McMahon

(57) ABSTRACT

The system defines an assembly formed by a truck with a compacting box of wastes and handling crane (3) of a receptor container, and containing the wastes assigned to be compacted, the compacting is carried out by a displaceable wall in the inside of compacting box, the crane (3) including a hooking device (12) of the container in order to place this one facing the upper loading door (7) of the compacting box (2), as well as a mechanism (16) to produce the opening of the corresponding unloading gates foreseen to such effect in the container (4) itself, when the hooking device (12) reaches the stop (13) in its displacement over the crane boom, the unloading gates (17) ot the container (4) being closed automatically when the hooking device (12) is in any other position over the crane boom.

3 Claims, 5 Drawing Sheets

RECEPTION, CONTAINING AND COMPACTING SYSTEM OF SOLID WASTES

BACKGROUND

1. Field of the Invention

The invention refers to a reception, containing and compacting system of solid wastes. The system is based on the combined use of a truck with crane, a truck box forming a compacting machine for wastes or solid materials, and a reception container for such waste. The reception container is directly handled by means of said crane to unload the wastes into a compacting box.

2. Description of the Prior Art

At present, the collection and elimination of urban and industrial wastes is carried out by municipal trucks that drive through the streets, industrial polygons and places in which containers containing solid wastes are located. These trucks reach the places where the solid wastes are located and by hooking the waste containers, the containers are either carried out (these ones being transported in the container properly hooked to the truck), or emptied into a milling hopper which is incorporated into the truck itself.

With the present art, the participation of some operators is necessary to carry out the hooking/unhooking of the containers. This produces two main problems. The first problem relates to the requirement of the operator or operators to carry out the mentioned operations. The second problem relates to the risk to which such operators are subjected to in the hooking/unhooking operations, sometimes accidents may happen which can be severe due to the disablement or loosing of fingers, hands, etc.

One system is described in document SU 1.272.638. In this case, the system comprises one track with a compacting box based on a backward and forward movement of a vertical wall driven by a hydraulic cylinder against an unloading back door. The load of the compacting box takes place by the knocking over of the container which is open in its upper part, on the loading gate of the compacting box. This knocking over takes place by means of an articulated arms crane. The most serious inconvenient of this device lies in the fact that it requires a tremendous skilfulness on the part of the worker, given that he/she must knock over the container exactly on the loading gate of the compacting box. Should the worker make a mistake, the unloading of the container could take place in any point within the work space. This would create a great danger for the passers-by.

In document FR 2.539.112, one can find an invention with a container with a bottom unloading gate. Such gate is held in a closed position by a vertically guided rod being locked in position by a latch mechanism. This container presents two types of problems; on the one hand, it is possible for the content of this type of containers to be stolen by people who operate by hand the latching mechanism. Furthermore, as a result of this kind of unskilled manipulation or due to ground unevenness, a failure of the latching mechanism can occur and the container could be raised, without taking notice, with the bottom unloading gate open, flooding the pavement with rubbish.

The present invention solves the aforesaid problems given that the worker only has to make sure that the crane boom is over the longitudinal axe of the truck. With the present invention, it is impossible for the automatic opening of the bottom unloading gate of the container to be in any other point in space other than over the loading opening of the compacting box. Additionally, in any other point in space, other than that cited, the bottom unloading gate of the container remains closed thanks to the positive action of a spring, making it impossible to manually operate the latching mechanism thus avoiding thefts, manipulations and even accidents due to lack of proper operation of the latching mechanism.

SUMMARY OF THE INVENTION

The system which is proposed, is based on an assembly formed by a truck with its compacting box, with a crane and an independent container. The present invention is designed to protect the operators from the risk of accidents, since the hooking/unhooking of a container is directly carried out by the crane driven by the operator.

Also the compacting box, as well as the container and the crane itself, have some new characteristics of which the functional and operational advantages of the assembly are derived.

More precisely, the compacting box is a box forming an integral part of the truck. The box is equipped with a back unloading door hydraulically driven. It also has a loading door located in the upper part. A vertical wall is installed inside the box in transversal position, displaceable towards the front and towards the back by means of a hydraulic cylinder driving a wall that in its displacement towards the back will carry out the compacting of the wastes against the back door when the door is in its closed position.

In reference to the reception and containing of the wastes in the container, the container is equipped with an internal mechanism based on connecting rods and levers in relation to some gates on its bottom so that such mechanism will maintain closed gates when they are in a resting position, and if it is driven by means of the crane the movement of the mechanism and the corresponding opening of the gates will be produced, emptying the wastes into the compacting box when such container has been previously hooked by the hooking device associated to the end of the crane boom, being this hooking device displaceable along the boom of the crane in order to arrange the container facing the upper loading opening of the compacting box and to make possible the emptying of the wastes from such container to said compacting box.

DESCRIPTION OF THE PREFERRED EMBODIMENTS

Figure 1:
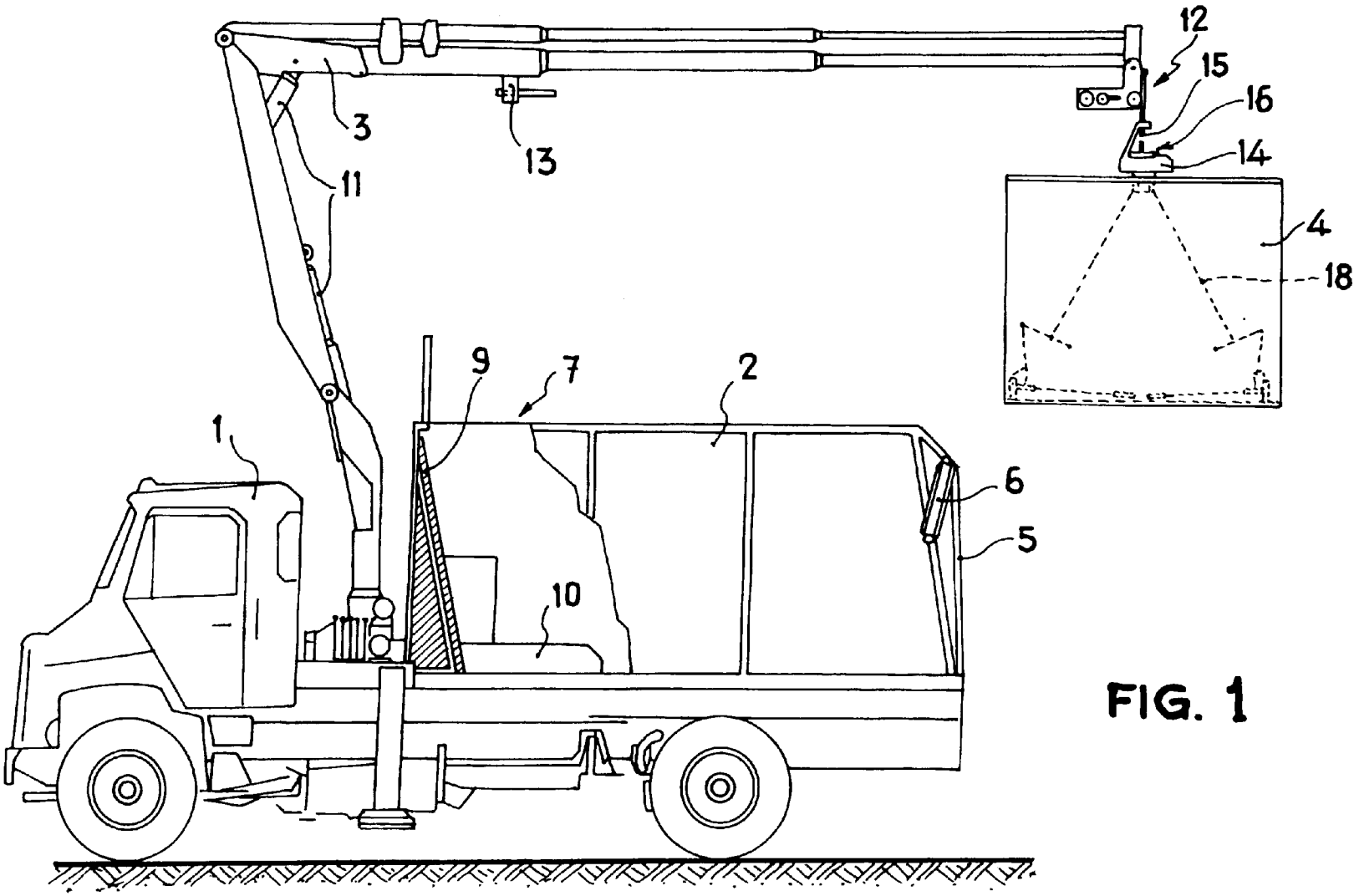
FIG. 1 shows a representation according to a lateral schematic view of the truck assembly with a compacting box and the crane, as well as the container.
Figure 2:
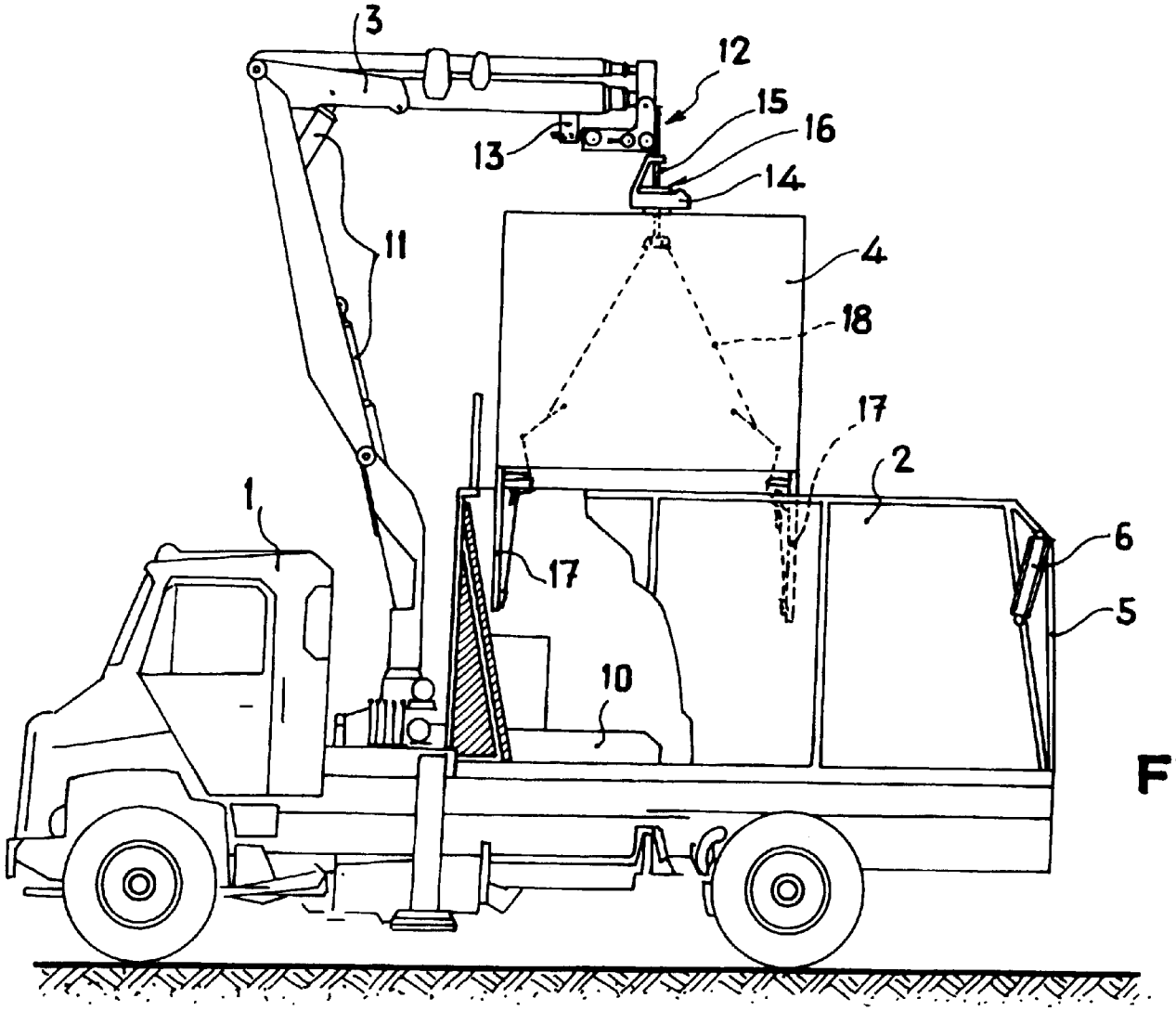
FIG. 2 shows same truck, crane and container but now the container is in the unloading position.
Figure 3:
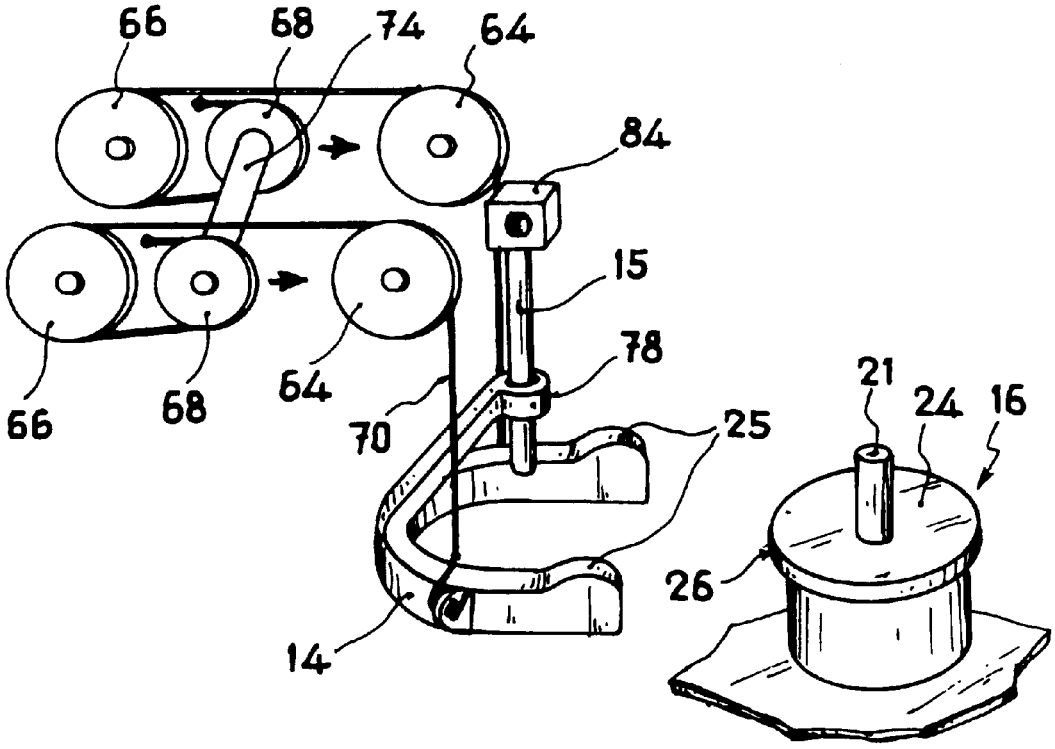
FIG. 3 shows a perspective schematic view of the hooking device.
Figure 4:
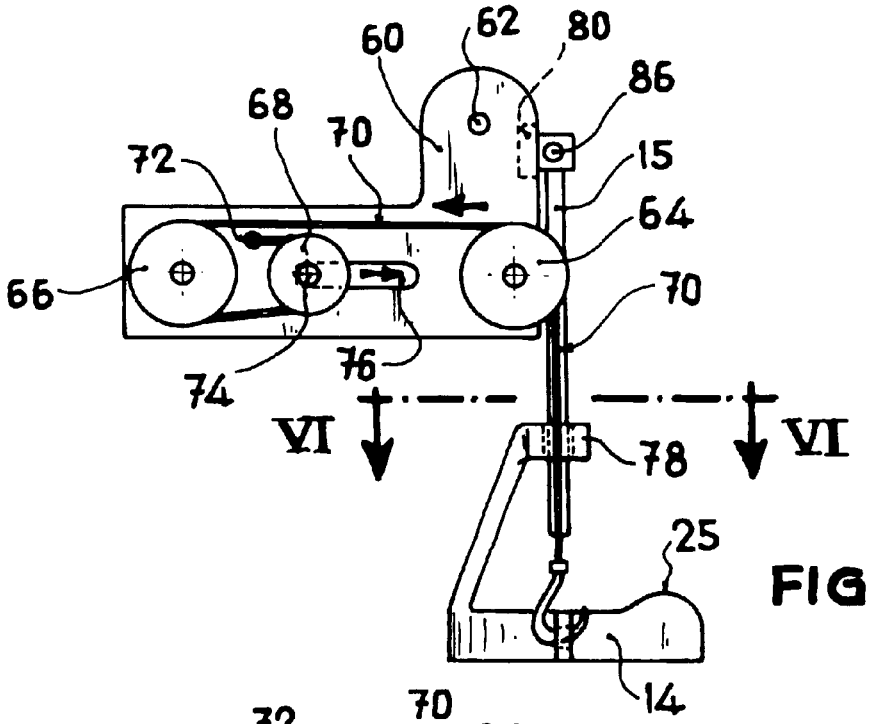
FIG. 4 shows a lateral view of the hooking device.
Figure 5:
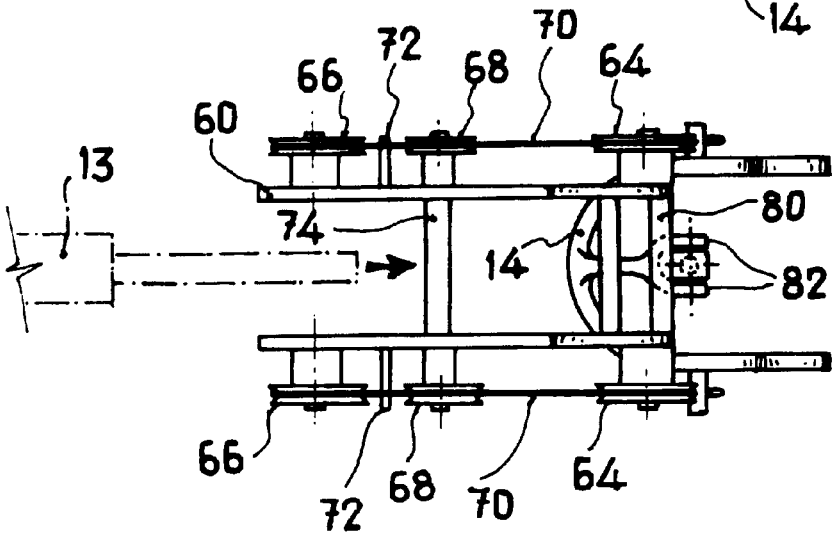
FIG. 5 shows a plant view of the hooking device.
Figure 6:
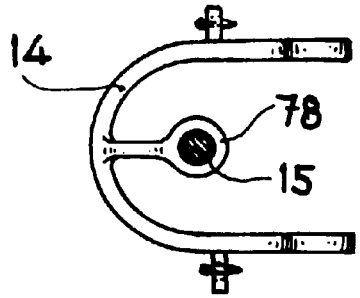
FIG. 6 shows a sectional view form VI—VI of the hooking device.

As it can be seen in the figures, the system of the invention comprises a truck (1) with a compacting box (2) and a crane (3), being complemented with an independent container (4) which will be directly handled by means of the crane (3) to carry out the emptying or unloading of the previously deposited wastes in such container (4) over the compacting box (2).

Such compacting box (2) is equipped with a back unloading door (5) driven by means of a hydraulic cylinder (6). This unloading door (5) will constitute the means of unloading the compacted wastes and will open upwards by tilting or rotating.

In the upper part, the compacting box (2) will be equipped with a upper loading opening (7).

Internally, the compacting box (2) is equipped with a transversal and vertical wall (9) which is displaceable towards the front and towards the back by means of a hydraulic cylinder (10), in order to carry out the corresponding pressing and compacting of the wastes deposited in the box itself (2), when the back unloading door (5) is in the closing position and the cylinder (10) is displaced backwards, and in order to unload by pushing the compacted wastes when the back unloading door (5) opens.

In reference to the crane (3) of the truck, it is equipped with driving hydraulic cylinders (11), as well as with a hooking device (12) which is displaceable between the end of the boom and a stop (13).

Such hooking device (12) consists of two parallel block and tackle mechanisms from which is suspended a fork (14) by way of cable (70). Said cable (70) passes over a first block (64) and goes backwards horizontally to a second block (66) from which it returns forward to embrace a third block (68), being the cable end (72) made fast to the hooking device frame (60) which can be mounted on the crane boom by way of mounting hole (62) and bolt. The third block (68) of the block and tackle mechanism are joined by a sliding axle (74) that can slide horizontally on a corresponding frame slot (76) when the sliding awe (74) is pushed forward by crane stop (13) as a result of the entire hooking device (12) being forced upon the stop (13) when the crane boom retracts as can be seen on FIGS. 2, 3, 4, 5 and 6.

The fork (14) presents two bumps (25) for retaining the flange (26), and a bearing (78) through which a vertical push rod slides (15) fixed by a cube (84) in an articulate manner to the frame (60) thanks to a bolt (86) that passes through two parallel lugs (82) of the transverse member (80) of the frame (60).

Over the central part of the top of the container (4) is provided an opening mechanism (16). Its housing (24) has a cylindrical shape with perimetral flange (26) so as to permit the coupling of fork (14) of the hooking device (12) integral to the crane boom (3).

A push-button (21) protrudes from the top of the mechanism housing (24) in front of the vertical push rod (15) of the hooking device (12).

Figure 8:
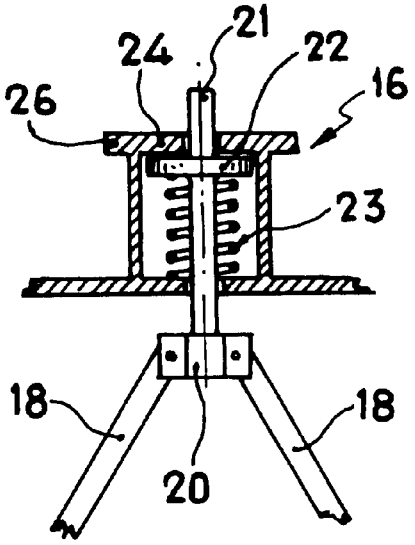
FIG. 8 shows a detail of the opening mechanism on top of the container.

In FIG. 8 we can see the push button (21) being pushed upwards by a very strong main spring (23) by way of a disc (22) integral to the push-button (21) This push-button ends in a transverse rod (20) that drives the bottom unloading doors (17) through two front and rear identical links.

Figure 7:
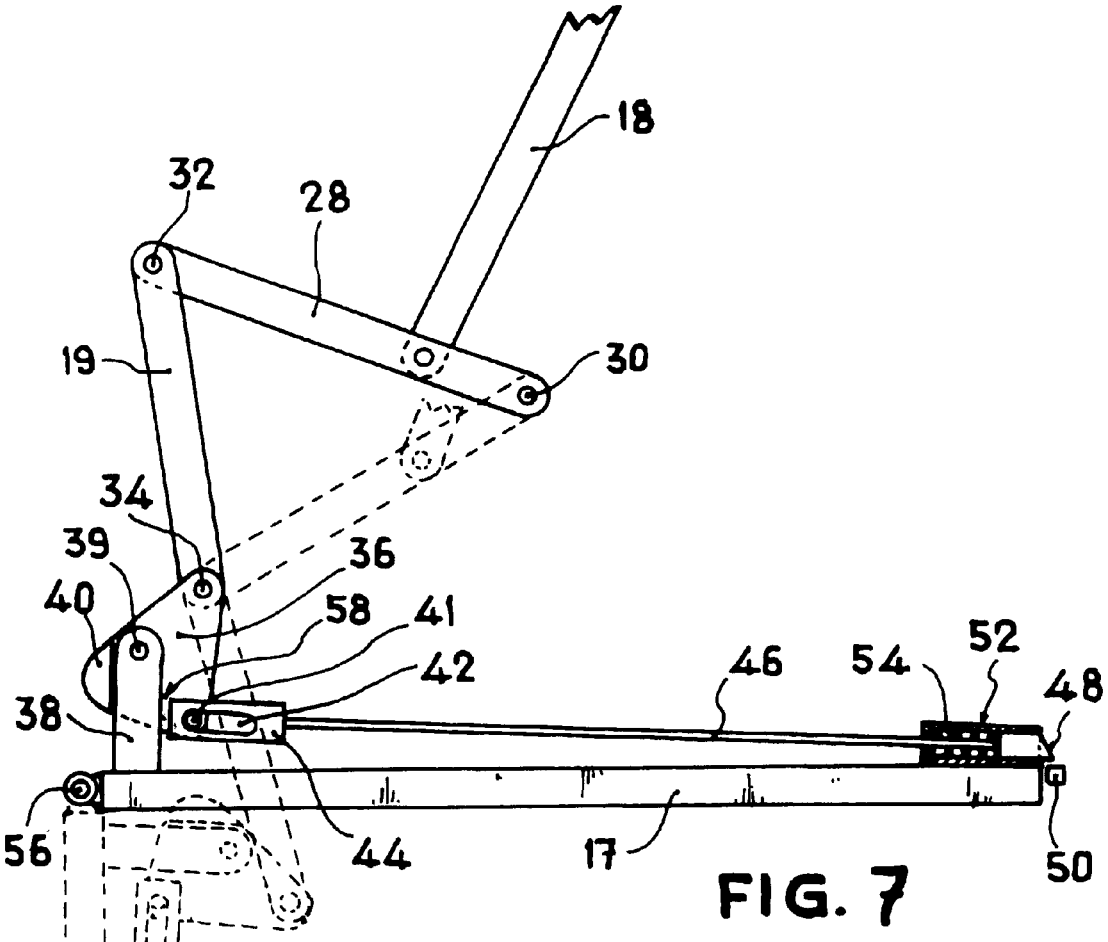
FIG. 7 shows a detail of one of the gates that close the bottom of the container.

FIG. 7 shows one of the four identical and symmetrical links which consist of a first rod (18) that acts upon a lever (28) fixed to the container (4) through its lever axle (30), the outer end (32) of this lever (28) acting upon a second rod (19) whose extreme end is attached to an oscillating plate (36) at an attachment point (34). This oscillating plate (36) can have a very slight oscillating movement over its plate axle (39), as will be explained later, driving the button unloading door (17) through a plate support (38) integral to the doors and on which plate axle is mounted (39). Finally, the oscillating plate (36) acts through latch axle (41) over the latch slot (42) of a latch fork (44) of a latch (48) that retains the door (17) as it is positioned over latch stop (50).

As can be seen in FIG. 1, after the fork (14) has been coupled to the opening mechanism (16) the container (4) may be lifted from the floor suspended from the crane boom (3). Then, the crane boom (3) retracts until the horizontal rod of the stop (13) pushes to the right the third block (68) of the hooking device (12). See FIGS. 2, 3 and 4.

This movement of the second block (68) of the hooking device causes the cable (70) to pull the fork (14) upwards and the container (4) with it, until the push button (21) of the opening mechanism (16) is pushed against the vertical push rod (15) fixed vertically on the hooking device (12). At this moment the push rod (21) is forced downwards inside the housing (24) against the spring (23) and together with it the transverse rod (20). As can be seen from FIGS. 7 and 8 this downward movement of the transverse rod (20) causes the first rod (18) to act upon lever (28) that rotates downwardlly, drawing second rod (19) attached to the oscillating plate (36) at attachment point (34). In a first moment, the oscillating plate (36) turns clockwise and through latch axle (41), latch fork (44) and latch stick (46) draws latch (48) out of latch stop (50) and against latch spring (54) housed inside latch housing (52) integral to unloading doors (17). At this moment the unloading door (17) begin to rotate clockwise over door hinges (56) as latch fork (44) is resting against plate support (38), and play (58) between them has disappeared. So, the unloading doors (17) have reached the position showed in FIG. 2 and the unloading of the container (4) takes place in the compacting box (2).

When the crane boom (3) expands, the second block (66) and third block (68) of the hooking device (12) get nearer, and the fork (14) goes down, releasing the pressure mechanism (16) of the container (4). The main spring (23) pushes now the transverse rod (20) upwards, and together with it, the first rod (18), lever (28) and second rod (19), the unloading door (17) rotating counterclockwise as plate stops (40) integral to oscillating plate (36) rest on plate support (38). At the end of the closing operation of the unloading doors, the latch (48) must retract inside latch housing (52) to overshoot the latch stop (50) what becomes possible by latch slot (42) and play (58) between latch fork (44) and plate support (38)

The description above contains many specificities. This description should not be construed as limiting the scope of the invention but as merely providing illustrations of the presently preferred embodiments of this invention. The scope of the invention should be determined by the appended claims and their legal equivalents.

What is claimed is:

1. Reception, containing and compacting system of solid wastes, comprising:

a) a truck (1) with a compacting box (2);

b) a crane (3) of the retracting boom type;

c) a container (4) with an opening mechanism (16) on its upper part wherein a push button (21) protrudes from the top of the mechanism housing (24) so, as said push button (21) is pushed downwards, some unloading doors (17) on the bottom of the container open against the action of a very strong spring (23), the opening mechanism (16) of the container (4) acting on the unloading doors (17) of the container (4) by way of a transverse rod (20) fixed to the push button (21) so that, when this push button (21) is pushed downwards, the transverse rod (20) pushes down a first rod (18) that acts upon a lever (28) fixed to the container (4) through a lever axle (30), the outer end (32) of the lever (28) acting upon a second rod (19) having an extreme end that is attached to an oscillating plate (36) which, save a certain rotating play, drags the unloading doors (17) in a rotating motion around hinges (56) fixed to the container (4); and d) means for opening the container (4) automatically over a loading opening (7) of the compacting box (2).

2. Reception, containing and compacting system of solid wastes, as claimed on claim 1, wherein the unloading doors (17) are provided with a latch (48) that retains the door (17) on a latch stop (50) fixed to the container (4), the latch (48) being retracted from the latch stop (50) at the very first moment of the opening movement by the oscillating plate (36) drawing on a latch fork (44) integral to a latch stick (46), integral to latch (48).

3. Reception, containing and compacting system of solid wastes, as claimed on claim 1, wherein means for opening the container consists of two parallel block and tackle mechanisms from which a fork (14) by way of a cable (70) is suspended, the cable (70) passing over a first block (64) and going backwards horizontally to a second block (66) from which the cable (70) returns forward to embrace a third block (68) being the cable end (72) made fast to the hooking device frame (60) so that, when the crane boom retracts, a stop (13) fixed on the crane boom (3) pushes forward one sliding axle (74), which joins the third block (68), and, as a result of that, the push button (21) of the opening mechanism (16) is forced against a vertical rod (15) fixed on the frontal part of the hooking device frame (60).

* * * * *